United States Patent [19]

Doss

[11] Patent Number: 5,075,598

[45] **Date of Patent: * Dec. 24, 1991**

[54] POWER SUPPLY CIRCUIT FOR GAS DISCHARGE TUBE

[75] Inventor: David Doss, Overland Park, Kans.

[73] Assignee: Everbrite, Inc., Milwaukee, Wis.

[ * ] Notice: The portion of the term of this patent subsequent to Oct. 15, 2008 has been disclaimed.

[21] Appl. No.: 421,988

[22] Filed: Oct. 16, 1989

[51] Int. Cl.[5] ..... H05B 41/36

[52] U.S. Cl. ..... 315/224; 315/219; 315/225; 315/279; 315/287; 315/307; 315/DIG. 7

[58] Field of Search ..... 363/18, 19, 56, 131; 315/291, 297, DIG. 7, 307, 224, 277, 279, 225, 226, 219, 287

[56] References Cited

U.S. PATENT DOCUMENTS

| | | | |
|---|---|---|---|
| 3,222,572 | 12/1965 | Powell, Jr. | 315/151 |
| 3,435,320 | 3/1969 | Lee et al. | 321/2 |
| 3,662,249 | 5/1972 | Wijsboom | 321/11 |
| 3,700,956 | 10/1972 | Cluett | 315/101 |
| 3,753,075 | 8/1973 | Tomura et al. | 321/44 |
| 3,909,747 | 9/1975 | Beierholm | 331/112 |
| 3,925,717 | 12/1975 | Kinnard | 321/2 |
| 3,964,487 | 6/1976 | Judson | 128/303.14 |
| 3,978,390 | 8/1976 | Remery | 321/44 |
| 3,989,995 | 11/1976 | Peterson | 321/2 |
| 4,005,335 | 1/1977 | Perper | 315/224 |
| 4,056,734 | 11/1977 | Peterson | 307/254 |
| 4,084,219 | 4/1978 | Furukawa et al. | 363/21 |
| 4,172,276 | 10/1979 | Kameya | 363/19 |
| 4,220,987 | 9/1980 | Rao et al. | 363/21 |
| 4,228,382 | 10/1980 | Virtanen | 315/219 |
| 4,283,759 | 8/1981 | Koiki | 363/19 |
| 4,286,194 | 8/1981 | Sherman | 315/209 R |
| 4,316,242 | 2/1982 | Colangelo et al. | 363/21 |
| 4,363,005 | 12/1982 | Kuroda et al. | 331/112 |
| 4,378,585 | 3/1983 | Bete | 363/19 |
| 4,385,347 | 5/1983 | Takematsu | 363/49 |
| 4,388,562 | 6/1983 | Josephson | 315/205 |
| 4,388,563 | 6/1983 | Hyltin | 315/205 |
| 4,420,804 | 12/1983 | Nishino | 363/21 |
| 4,441,087 | 4/1984 | Nilssen | 331/113 A |
| 4,443,838 | 4/1984 | Yamada | 363/19 |
| 4,443,839 | 4/1984 | Onodora et al. | 363/20 |
| 4,481,564 | 11/1984 | Balaban | 363/21 |
| 4,484,108 | 11/1984 | Stupp et al. | 315/219 |
| 4,486,822 | 12/1984 | Marinus | 363/19 |
| 4,504,775 | 3/1985 | Becker | 320/32 |
| 4,559,478 | 12/1985 | Fuller et al. | 315/224 |
| 4,587,461 | 5/1986 | Hanlet | 315/224 |
| 4,613,934 | 9/1986 | Pacholok | 363/131 |
| 4,654,771 | 3/1987 | Stasch et al. | 363/19 |
| 4,654,772 | 3/1987 | Thorne | 363/19 |

*Primary Examiner*—Eugene R. LaRoche
*Assistant Examiner*—Do Hyun Yoo
*Attorney, Agent, or Firm*—Michael, Best & Friedrich

[57] ABSTRACT

A power supply for high voltage, low current gas discharge tubes such as neon, argon, and mercury vapor. A free running, flyback oscillator, converts D.C. voltage energy into radio frequency energy by means of a compact, ferrite transformer and associated circuitry. The primary winding is tuned by a resonant capacitor and driven by a power transistor. A high voltage, centertapped winding of a ferrite transformer drives the gas tube load directly. A feedback winding arranged across the transistor base and emitter junction sustains oscillation and controls the drive level of the transistor by means of a regulating circuit which controls the amplitude of the current. Oscillator starting is achieved by means of an on-off switch which supplies a single starting pulse to the power transistor or by means of a time delayed starting pulse. A MOSFET transistor connected to the power transistor base and a current sensing transformer arranged in series with the primary winding, disables the power transistor momentarily at the end of a conducting cycle. Charge carries are depleted in the base-cathode region, resulting in resetting the transistor quickly such that it can withstand a forward voltage of 700 volts in the off state.

3 Claims, 4 Drawing Sheets

54
43
34
R17
R16
R18
Q12
D12
R2
Q2
118
114
D1
SW
122
D3
C1
D4
Q5
D2
R3
R31
R1
C7
Q1
90
C13
Q11
Q12'
C14
50
30
98
L1
L5
L2
130
146
M
150
138
R11
Q6
R12
C6
38
102
D8
142
L6
L3
62
154
110
L7
L4
106
42
R4
C8
R5
R6
Q2'
Q7
C10
R8
R7
D5
Q8
Q9
D7
R9
R10
Q6'
R19
C9
D6
58
Q3'
62
R13
Q3
D9
Q4
Q10
D10
66
R15
C12
R14
C11
D11
70
170
74
C2
90
94
C4
D20
C5
66
82
C3
78
86

FEEDBACK/AUXILLARY WINDINGS

TRANSISTOR EMITTER CURRENT

TRANSISTOR BASE VOLTAGE

TRANSISTOR EMITTER VOLTAGE

TRANSISTOR BASE CURRENT

RESONANT CAPACITOR CURRENT

CURRENT SENSE PULSE

GAS TUBE LOAD CURRENT

POWER SUPPLY CIRCUIT FOR GAS DISCHARGE TUBE

BACKGROUND OF INVENTION

This invention relates to power supplies and more particularly to a solid state, high efficient supply which converts D.C. energy to high frequency A.C. energy for the purpose of supplying gas discharge tubes with high voltage at relative low currents in a range of 15-55 milliamperes (ma) in a range of 15-115 watts. The high voltage may vary from one kilovolt to 10 kilovolts depending on the glass diameter, length, bends, type of gas, etc.

Upon ionization of a gas discharge tube by means of high voltage resulting in current flow, the atoms of neon are stimulated to emit an orange-red light. Other gases which glow when electrically energized are mercury vapor (blue-green), argon (pale blue), and a mixture of the two (deep blue). Pigmented fluorescent coatings are used with mercury vapor gas to produce many visible hues of light quite efficiently.

One type of prior art power supply is simply 60 Hz transformers where 120 volts A.C. is applied to the primary of the transformer and the secondary winding output voltage is connected to the tube load. By utilizing a large ratio of primary secondary turns such as 50-100, high voltages are induced up to 10 kilovolts. Such systems are heavy, for example 10-12 pounds, dangerous, and may be as inefficient as 85% resulting in high internal temperatures and low reliability. Several sizes of transformers are available to prevent an underdrive or overdrive of the tube load.

More recent solid state power supplies are lighter, more efficient, and operate silently compared with the 120 Hz audible noise from 60 Hz power supplies. However, specific problems are evident with such power supplies, such as: a) the series resonant type of oscillators employed result in a "beading" of the energized neon gas which is displeasing to the eye; (b) the lack of secondary short circuit protection so the system can fail when the secondary is shorted; (c) the lack of open circuit protection resulting in high voltages up to 16 kilovolts which is dangerous and may result in an arc and a fire; (d) the lack of protection from an open secondary lead or a broken tube which can cause a fire; (e) inadequate protection of persons who may come in contact with the high voltage by touching one of the leads; (f) the absence of a method to set and regulate the amplitude of current to a gas discharge tube often results in failing the tube load; and (g) the absence of circuit capability to connect a millampmeter for the purpose of adjusting the load current to a safe value.

It has been found that tubes filled with mercury vapor gas tend to degrade when excess current is allowed to flow in the tubes due to excessive voltage. For example, such degradation has been observed in window neon signs with currents which exceed the nominal current by only 20%. The general symptom resulting from current overdrive is a dimming or darkening of specific sections of the tube caused by condensation of the mercury vapor which results in reducing the secondary emission of light from the flourescent coating.

Gas discharge tubes have a negative coefficient of resistance with current. That is, the tube's resistance decreases as the current through it increases which suggests that a runaway condition exists if the current is not regulated.

The glass used for window neon signage range from 9-12 mm. High voltage, gas discharge tubes used for lighting are generally 15 or 18 mm's, are filled with mercury gas, and emit white light. The area of the glass inside diameter determines the amount of high voltage and resultant current which will be tolerated by mercury vapor sections of signs or lighting systems. In commercial practice, the outside diameter of the glass is used as reference rather than the inside diameter. The following table illustrates the nominal and damaging currents for lighting devices of various sizes.

| Use | Range mm | Optimum ma | Damaging ma |
|---|---|---|---|
| Sign | 8-9 | 20 | 24 |
| Sign | 9-10 | 22 | 26 |
| Sign | 10-11 | 24 | 28 |
| Sign | 11-12 | 26 | 31 |
| Lighting | 15 | 34 | 41 |
| Lighting | 18 | 41 | 49 |

Neon gas tubing is not easily damaged by excessive voltage and resultant current, however neon and mercury vapor sections generally are arranged in series in signage resulting in the need for regulation of the current because of the mercury vapor sections. Also, when more than one section of tubing is used to configure the sign, such as four sections of different colors, the smallest diameter mercury vapor section determines the safe current limit. Often tubes are bent sharply during the manufacturing process resulting in reducing the area of the tube at these points by the equivalent of 1-2 mm's.

SUMMARY OF INVENTION

An object of the invention is to provide a power supply for gas discharge tubes whose high voltage and load current may be adjusted to the optimum value by means of an inexpensive digital V.O.M. meter.

Another object of the invention is to provide a power supply for gas discharge tubes which regulates load current over a wide range of gas tube load.

An object of the invention is to provide a power supply for gas discharge tubes wherein load current regulation is provided over a wide range of the ambient temperatures.

Another object of the invention is to provide a power supply for gas discharge tubes wherein load current regulation is provided over a wide range of the input A.C. voltage.

An object of the invention is to provide a power supply for gas discharge tubes wherein high voltage, high frequency energy is provided to the tube load only during the time when the power transistor is turned off, preventing the load impedance from having any immediate effect on the transformer primary circuit.

A further object of the invention is to provide a power supply for neon gas filled tubes which does not cause beading.

Yet another object of the invention is to provide a power supply for a gas filled tube which is highly efficient.

An object of the invention is to provide a power supply which is quiet, compact, light weight, and reliable.

Another object of the invention is to provide a power supply which may be packaged in a vented, plastic box without exposed metal and which is only warm to the touch during operation.

An object of the invention is to provide a power supply for gas tubes applied to signage where a single setting of the load current is adequate to safely drive all signs over a wide range of wattages.

Another object of the invention is to provide a power supply which includes failsafe circuitry which prevents injury to persons who may accidentally touch the circuitry by disabling the high voltage.

An object of the invention is to provide a power supply with failsafe circuitry which prevents accidental fires in case either high voltage load is opened, the gas discharge tube is broken, or shorted, or an open connection develops between the high voltage source and the tube load.

Another object of the invention is to provide a power supply which can be turned on safely without a load and which disables the high voltage if the high voltage is touched during this condition.

An object of the invention is to provide a power supply with which minimum circuit alterations converts low voltage D.C. to high voltage A.C. where the D.C. voltage may be a combination of auto type batteries or D.C. derived by rectifying an A.C. source where the frequency is not critical to performance.

Another object of the invention is to provide a power supply operating in a power range of 15–115 watts and providing currents up to 50 ma's for tubes used for lighting such as 15–18 mm's.

In general terms, the invention comprises a power supply circuit for energizing a gas-filled tube and including oscillating means having transformer means provided with primary winding means and secondary winding means connected to the gas-filled tube. First circuit means is coupled to the primary winding means and has an on mode for providing current to the primary winding means and an off mode wherein current does not flow. The first circuit means also includes first control means for placing the first circuit means in its on mode upon the receipt of a control signal and feedback means is coupled to the primary winding means and to the first control means for providing a control signal to the control means when a predetermined current condition exists in the primary winding. Second circuit means is coupled to the first control means and includes second control means. The second circuit means is operative upon the receipt of a control signal to place the first circuit means in its off mode and sensing means is coupled to the primary winding means and is operative to sense a second predetermined circuit condition for producing a control signal to the second control means.

In the preferred embodiment, the invention includes an oscillator which is free running, operates in a flyback mode, and is self resonant at 20 KHz. A power transistor configured as a common collector drives the primary of the high voltage transformer where the primary inductance is tuned by a resonating capacitor. The frequency of the oscillator is derived from the equation where F is Hz, L is Henrys, and C $$F=\tfrac{1}{2}LC$$

is Farads.

A feedback winding operating in the regenerative mode supplies a rectified DC signal to the power transistor base to sustain oscillation. The amplitude of the feedback signal is controlled by an in series current regulator which samples the tube load current and adjusts the drive level of the power transistor to increase or decrease the high voltage and load current as required by the set value. A potentionmeter is used to set the load current to the desired value.

The illuminance (brightness) of a gas discharge tube is directly proportional to the voltage across it and the current through it (W=EI).

A MOSFET transistor is connected between the base-emitter circuitry of the power transistor and is driven on at the instant the emitter current of the power transistor attempts to decrease resulting in negative drive which instantly disables the power transistor. A pulse transformer connected in series with a one turn primary winding senses the current decrease and generates a gate-source positive pulse enabling the MOSFET which disables the power transistor.

The circuit described results in maximum efficiency of the power transistor since it is forced to operate either on or off like a switch resulting in minimum power loss in the device. When the transistor is on, it is saturated and the collector-emitter resistance is very low. When switched off, the resistance is infinite. Another benefit of the MOSFET switch is to provide a base-emitter junction circuit path for charge carriers which assists in rapid turn off of the power transistor with a significant improvement in heat loss of the power transistor.

The rapid depletion of the charge carriers allows the power transistor to quickly block the forward voltage between the emitter-collector junction resulting from the flyback voltage.

The high voltage transformer includes a split ferrite core with an air gap of 0.60", for example, which provides leakage reactance for the transformer. The primary winding is wound with stranded litz wire to minimize skin effect $IR^2$ losses resulting from the high frequency current.

When the power transistor conducts, the electrical energy of the primary winding is stored in the air gap in the form of a magnetic field. When the transistor is turned off, the magnetic energy is released to the core and secondary windings which drives the tube load. Induced voltage occurs in the feedback winding which results in oscillation and an auxillary winding which powers two low voltage supplies; one for the failsafe circuit and the other for the current regulator.

The power supply oscillator is not self starting. An on-off switch, operated as a push-pull switch alternately turns the oscillator on and off. When off, the power transistor base is grounded to circuit common. On reversing the switch, a +12 volt, short duration pulse, +12 volts, for example, is applied to the power transistor base which enables the transistor and oscillation begins.

A second starting circuit is required by the failsafe circuit. When a problem is detected by the failsafe circuit, the oscillator is disabled. After a delay of five seconds, for example, a timer generates a voltage pulse, +30 volt 100 microsecond pulse which is applied to the power transistor gate which restarts the oscillator if the problem has been corrected. This timer also restarts the power supply in case of a power outage or if the load is controlled by a day/night timer.

DETAILED DESCRIPTION OF THE PREFERRED EMBODIMENT

While various specific voltages, currents and wattages are referred to in the following description, it is to be understood that these are merely values obtained in one specific embodiment and are intended only for purposes of illustration and not to limit the scope of the invention.

Figure 1:
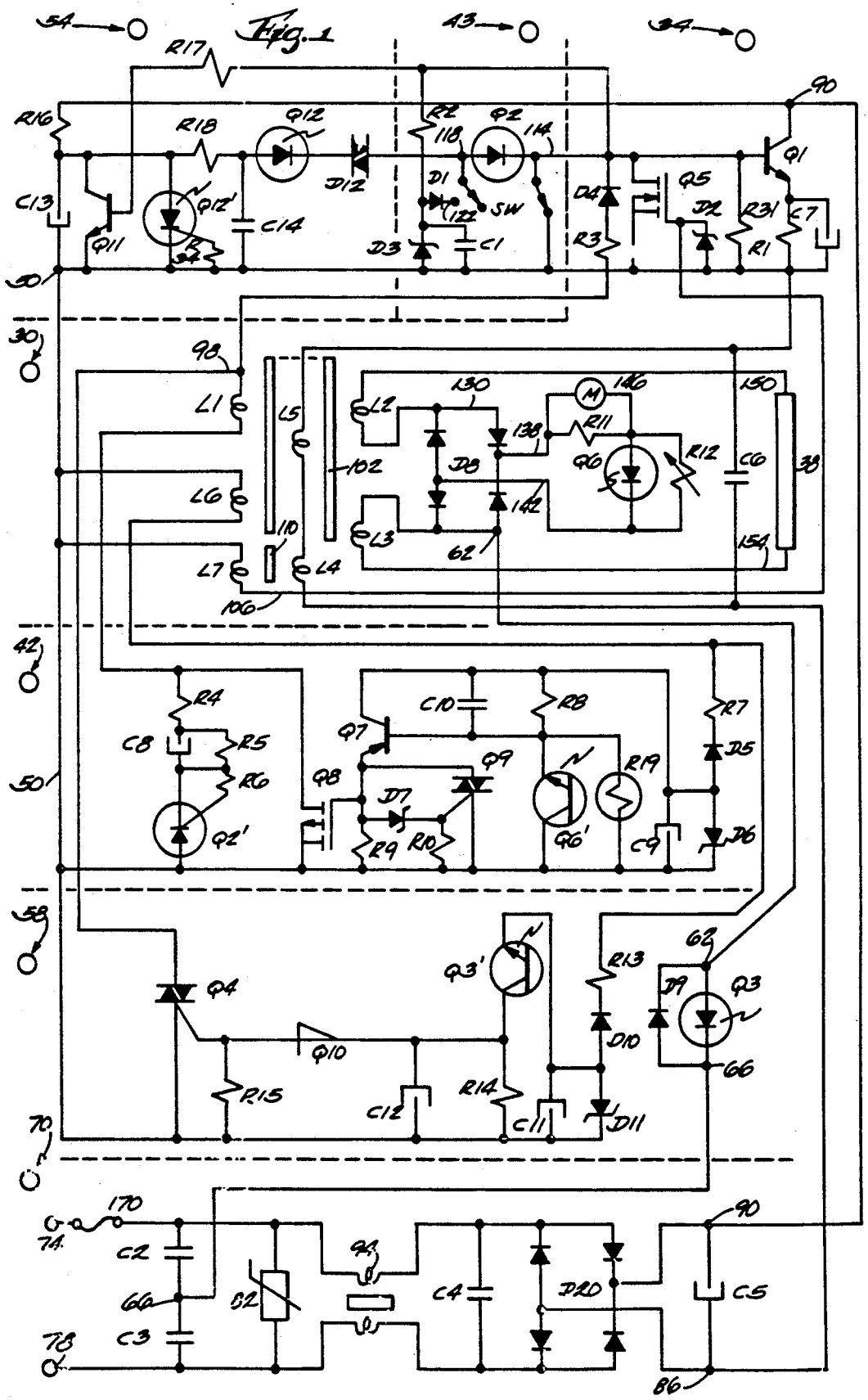
FIG. 1 is a schematic diagram illustrating a power supply according to the preferred embodiment of the invention.

The power supply circuit 30 is shown generally in FIG. 1. According to the preferred embodiment of the invention, the circuit includes an oscillator 34 which supplies low current, high voltage energy to a load such as a gas discharge tube 38. A current regulating circuit 42 is arranged in series with the oscillator feedback winding L1 and adjusts the high voltage across load 38 by sensing and controlling the current through load 38. The optimum current for beverage sign loads ranges from 20–26 ma.

On-off switch SW of starter circuit 43 is a two pole, two position (2P2P) switch which shorts the base of a transistor Q1 to circuit common 50 in the off mode. When turned on, the switch SW applies a 12 volt positive pulse from capacitor C1 to the transistor Q1 base through diode D1 and opto LED Q2, which enables oscillator 34. Timer 54 provides a starting pulse, delayed by 5 seconds for example, to restart oscillator 34 in case of a power outage or in case the failsafe circuit has disabled the oscillator.

A failsafe circuit 58 connects to the centertap of high voltage windings L2 and L3 at trace 62 and earth ground trace 66 through opto LED Q3. Any unusual increase in the centertap current to ground activities opto coupler Q3' enabling failsafe circuit 58 and its output triac Q4 which short circuits the feedback signal at the gate of transistor Q1, disabling the oscillator 34 and the high voltage. A restart is attempted every 5 seconds by timer 54. An open circuit of either high voltage lead also activates the failsafe circuit 58.

A full wave rectifier circuit 70 provides a D.C. power supply of 160 volts at 3.0 amperes for the power supply 30. 120 volts A.C. connect to terminals 74 and 78. A tuned, passive filter consisting of capacitors C2 and C3, transformer 94, and capacitor C4 reject all but 5 millivolts of the 20 KHz oscillator signal measured at A.C. input terminals 74 and 78. A varistor 82 clamps noise spikes above 130 volts. The peak voltage of the 120 volt RMS A.C. voltage is 160 volts D.C. and is stored in bulk capacitor C5.

The primary current path of oscillator 34 begins with the negative end of bulk capacitor C5, trace 86, and consists of a series arrangement of pulse winding L4, the primary winding L5 paralleled by resonant capacitor C6, emitter bias circuit, resistor R1 and capacitor C7 connected in parallel, and the emitter-collector junction of transistor Q1 where the collector terminates at the positive end of capacitor C5, trace 90. Several amps of pulsating D.C. current flow in this path during oscillation.

In addition to the primary winding L5, transformer 98 includes mutually coupled windings L2 and L3 which provide high voltage to load 38, feedback winding L1 which sustains oscillation, and auxillary winding L6 which provides A.C. voltage for two low voltage D.C. power supplies required of the current regulator circuit 42 and the failsafe circuit 58. A common ferrite U core 102 including an air gap complete a magnetic circuit which mutually couples the windings.

Pulse transformer 106 includes a single turn primary L4 and a 100 turn secondary winding L7 mutually coupled by ferrite core 110. Secondary L7 connects directly to circuit common 50 and the gate of MOSFET Q5. The gate-source junction of MOSFET Q5, Zener D2, and the secondary winding L7 are parallel connected.

Biasing network resistor R1 and capacitor C7 are parallel connected and complete the circuit between the transistor Q1 emitter and circuit common 50. The bias voltage established by the current flowing through resistor R1 and capacitor C7 is applied directly to the Q1 emitter-base junction by means of MOSFET Q5 when it is enabled by the failsafe circuit 58.

Switch SW is a 2P2P on-off switch. In the off mode, the armature 114 shorts the base of the power transistor Q1 to circuit common 50 disabling the oscillator. Moving the switch to "on" results in opening armature 114, removing the base short of transistor Q1. Simultaneously armature 118 connects to position 122 of switch SW which allows the voltage in capacitor C1 to discharge through diode D1, switch SW, opto LED Q2, and the base-emitter junction of transistor Q1; enabling transistor Q1 and oscillator 34. Resistor R2 charges capacitor C14 from +160 D.C., trace 90. Zener diode D3 regulates the charge to 12 volts.

When transistor Q1 is turned on by the starting pulse from the on-off switch SW, 160 volts D.C. is applied across the primary winding L5 and its resonant capacitor C6 introducing sufficient energy to cause a damped wave oscillation. All windings mutually coupled to L5 are energized including feedback winding L1 which is required to sustain oscillation. Winding L1 connects directly to the transistor Q1 base through resistor R3 and schottky diode D4. On the opposite side of winding L1, a closed series circuit is arranged through a network consisting of resistor R4, resistor R5 and capacitor C8 in parallel, and opto silicon controlled rectifier (S.C.R.) Q2' to circuit common 50. Resistor R6 shunts the gate-cathode junction of opto transistor Q2'.

When the on-off switch SW is switched on, C1 discharges through opto LED Q2, turning on opto S.C.R. Q2' which closes the feedback series circuit momentarily. Once turned-on, opto transistor Q2' remains on until the D.C. current flowing through capacitor C8 charges C8 to a voltage equal and opposite to the source voltage from winding L1 which removes the voltage from opto S.C.R. Q2' and opens the circuit feedback to circuit common 50.

Voltage is induced into the oscillator feedback winding L1 and auxillary winding L6 synchronous with the starting pulse. One end of winding L6 is grounded and the other end charges capacitor C9 with −8.2 volts through the series circuit of resistor R7, diode D5, and the 8.2 volt zener D6 which parallels C9. The 8.2 volt charge in capacitor C9 serves as −8.2 a volt D.C. supply for the current, regulator 42.

The −8.2 volts is applied across resistor R8 and opto transistor Q6' in series which act as a single ended bridge to control the base voltage of transistor Q7. Transistor Q7 is connected as an emitter follower with the collector connected to −8.2 volts and the emitter returned to circuit common 50 through resistor R9, which directly drives the gate-source junction of MOSFET Q8. Until opto transistor Q6' conducts, which will subsequently be discussed, MOSFET Q8 is turned on completing the series oscillator feedback path from circuit common, MOSFET Q8, winding L1, resistor R3, diode D4, base-emitter junction of transistor Q1, and the parallel configuration of resistor R1 and capacitor C7 to circuit common. The resultant positive feedback to transistor Q1 sustains oscillation. Capacitor C10 connected across the collector-base junction of transistor Q7 operates in a degenerative mode which suppresses oscillation of Q7 in the regulation circuit.

The anode-cathode junction of a triac Q9 shunts the transistor Q7 emitter load resistor R9 with its gate biased from the centertap of zener diode D7 and resistor R10 which is also parallel resistor R9. A subsequent discussion follows.

In circuit 34, a bridge rectifier D8 is arranged in series with high voltage windings L2 and L3 at terminals 130 and 62 and the gas discharge load 38. The rectified D.C. output of the bridge rectifier D8, traces 138 and 142, is applied to opto LED Q6 through series resistor R11. A current calibrating potentiometer R12 shunts LED Q6 providing an adjustment of the current through opto LED Q6 which varies the resistance of opto transistor Q6' in the current regulator 42. A digital V.O.M. 146, adjusted to read D.C. ma, directly measures the current in load 38 when connected across resistor R11. The amount of load current can be set to the desired value by simply adjusting potentiometer R12 while viewing the meter. The brightness of the tube 38 varies in proportion to the meter current. Increasing the current increases the high voltage across the tube load.

The value of resistor R11 is not critical and may have a range of 100-500 ohms. In one embodiment of the invention, a 200 ohm resistor was used. When the meter 146 is used, practically all of the current flows through the meter due to its low resistance. When the meter is not used, all of the load current flows through resistor R11 producing a small drop of 5 volts if the load current is 25 ma (E=IR). In an experimental embodiment of the invention, a female jack was provided such that a millimeter may be plugged-in when needed to set a load current.

Opto diode Q6 is an LED whose light output is directly proportional to the current through it. The emitter-collector resistance of opto transistor Q6' is directly proportional to the light received from LED Q6. When the load current through tube 38 tends to decrease, reducing the light to opto transistor Q6', the emitter-collector resistance increases. Referring to the current regulator 42, an increase in the transistor Q6' resistance increases the base drive voltage of transistor Q7 increasing its emitter voltage and the gate-source voltage of MOSFET Q8. The source-drain resistance of Q8 reduces increasing the feedback current to the power transistor Q1 resulting in an increase of current through transistor Q1 and the primary winding L5, as well as the high voltage current to load 38. Therefore any tendency for the load current through tube load 38 to change is countered by an opposite change resulting from the current regulation of circuit 42.

Trace 62 at the centertap end of high voltage winding L3 is returned to earth ground at the centertap of capacitors C2 and C3 through opto LED Q3, shunted by diode D9. Any unbalance in resistance or capacitance of tube load 38 at end 150 or 154 relative to earth ground results in current flow from centertap 62 through opto LED Q3 to earth ground 66. The resistance of opto transistor Q3' is reduced by the light from LED Q3.

Auxiliary winding L6 provides an A.C. voltage for a −12 volt power supply for the failsafe circuit 58. One end of L6 connects to circuit common 50 and the other end to resistor R13, diode D10, and capacitor C11 in series. Zener diode D11 regulates the voltage across capacitor 11 to −12 volts. The isolation breakdown voltage between LED Q3 and opto transistor Q3' is 7.5 kilovolts which prevents the high voltage circuit of 34 from effecting any other circuit of power supply 30.

The series arrangement of opto transistor Q3' and resistor R14 connect in parallel across capacitor C11 and share the −12 volt supply. Opto transistor Q3 and resistor R14 is a single ended bridge whose output appears across capacitor C12 which shunts resistor R14. The voltage charge in capacitor C12 is applied to the input of unijunction transistor Q10 which is connected as a two terminal switch. At 7 volts, UJT Q10 fires discharging capacitor C12 through the gate-cathode junction of triac Q4, shunted by resistor R15. The cathode-anode junction of triac Q4 conducts shunting the transistor Q1 base to common 50, thereby disabling oscillator 34.

Any unbalance of resistance or capacitance at either end of tube load 38, traces 150 or 154, causes current to flow through LED Q3' lowering the emitter-collector resistance of transistor Q3 charging capacitor C12. An unbalance results from a human touch of either end of the tube load 38, an open lead 150 or 154, or a broken tube. If the unbalance causes a current flow of 2 ma in LED Q3, the charge in capacitor C12 will exceed the 7 volt threshold of UJT Q10 causes it to conduct, enabling triac Q4 and disabling power transistor Q1 and oscillator 34.

Without a timer to restart the oscillator, a single operation of the failsafe circuit renders the oscillator inoperative until the on-off switch SW is turned off, then on. A timer is illustrated in block 54. Its purpose is to provide a starting pulse to transistor Q1 to restart the oscillator 34 after a delay of five seconds. After the initial turn off by the failsafe circuit 58, the five second timer 54 attempts to restart the oscillator 34 each five seconds until the problem is cleared.

If the failsafe circuit continues to detect a failure, the oscillator 34 will not restart, therefore transistor Q11 cannot discharge C13. Opto SCR Q12' is momentarily switched on each time the diac D12 fires because opto LED Q12 is in series with diac D12. Therefore opto SCR Q12' discharges capacitor C13, resulting in resetting the five second timer for another 5 seconds.

Window neon signs are often turned on and off with real time clocks. In this case, the five second timer 54 starts oscillator 34 after the delay.

Resistor R16 and capacitor C13 are connected in series from +160 volts D.C., trace 90, to circuit common 50. Transistor Q11 shunts C13 and normally prevents a charge in capacitor C13 because the base signal of transistor Q1 is coupled to the base of transistor Q11 through resistor R17 causing the emitter-collector junction transistor Q11 to conduct preventing a charge in capacitor C13. When the oscillator 34 is disabled by the failsafe circuit 58, transistor Q11 ceases conduction and capacitor C13 charges through resistor R16. In the experimental embodiment of the invention, these values are chosen to allow capacitor C13 to charge to 30 volts D.C. in 5 seconds.

As capacitor C13 is charging to 30 volts, capacitor C14 is charged to the same value of voltage through resistor R18. Diac D12 fires at 30 volts discharging capacitor C14 through the series path of opto LED Q12, diac D12, opto LED Q2, base-emitter junction of transistor Q1, and circuit common through resistor R1 and capacitor C7 in parallel. The single positive pulse saturates the base-emitter junction of Q1 enabling oscillator 34. Transistor Q11 is turned on by the signal from the base of transistor Q1 discharging capacitor C13 and maintaining a low resistance path across it preventing a recharge.

As mentioned above transistor Q1 is switched on by a current pulse from capacitor C14 which is simultaneously charged by capacitor C13 through resistor R18. Capacitor C14 is only 1% of the capacitance value of capacitor C13 reducing the pulse width to transistor Q1 and the possibility that transistor Q1 may receive a feedback signal simultaneous with the starting pulse. In the experimental embodiment of the invention, the pulse width of the capacitor C14 signal is 100 microseconds. Opto LED Q12 is pulsed on each time that timer 54 operates which automatically causes transistor Q11 to conduct discharging capacitor C13 and resetting the 5 second timer, otherwise the failsafe circuit would not reset; disallowing the failsafe circuit from interrogating the load 38 and associated circuitry.

The current regulator 42 includes one feature not previously discussed. The power supply 30 can be turned on without the load 38 being connected to the high voltage terminals 150 and 154. Very little current flows through the regulator opto LED Q6 under this condition, resulting in opto transistor Q6' being high in resistance causing transistor Q7 to develop in excess of 6.2 volts at its emitter and at the gate of MOSFET Q8 resulting in maximum feedback drive to transistor Q1 and excessive high voltage.

Under this condition, zener diode D7 interrogates the transistor Q7 emitter voltage and conducts at −6.2 volts D.C. which causes saturation of the gate-cathode and cathode-anode of triac Q9 resulting in a low voltage at the gate of MOSFET Q8 causing a high impedance of MOSFET Q8 and practically an open circuit of the feedback path, thereby reducing the high voltage to only 1 or 2 kilovolts which is relatively safe. Once turned on, triac Q9 cannot turn off if any voltage remains between its anode and cathode. Under this condition, the failsafe circuit 58 operates normally and disables the oscillator 34 if either high voltage leads 150 or 154 are touched. The circuit automatically resets with the on-off switch or if the A.C. input voltage is disconnected.

The current regulator circuit 42 includes thermistor R19 which provides thermal compensation of optocoupler Q6' which has a positive temperature coefficient; that is, the collector-emitter resistance of Q6' increases as the temperature inside the power supply housing rises as a result of a change in load 38 or an ambient temperature change without thermal compensation, an increase in the opto transistor Q6' resistance boosts the feedback drive to transistor Q1 increasing the high voltage and current to load 38. To off-set an increase in the opto transistor Q6' resistance, thermistor R19 shunts opto transistor Q6' and has a negative temperature coefficient. In the experimental embodiment of the invention, R19 was 10K ohms and decreased 4%/°C. between 25° C. & 100° C. The thermal compensation provided by thermistor R19 allows the current regulator 42 to meet a specification of ±1 ma with load changes of 15–115 watts or an ambient temperature change of 35 25° C.

Power transistor Q1 is an inexpensive bipolar transistor commonly used in various forms of switching power supplies generally designed for specific D C. voltage loads such as personal computers. When driven off, it must withstand forward voltages up to 800 volts D.C. and 3 amperes peak when driven on. In the experimental embodiment, transistor Q1 is mounted to an aluminum, extruded heatsink which dissipates about 3 watts with a tube load of 110 watts. The plastic enclosure of the Power supply is slotted providing sufficient draft for air to flow across the heatsink cooling the power transistor Q1 and MOSFET current regulator Q8 . Transistor Q1 mounts on one end of the heatsink and MOSFET Q8 on the opposite end.

In the experimental embodiment, the power transformer 98 is mechanically configured in a rectangular shape with two transformer bobbins positioned over air gaps resulting from butting two ferrite U cores together. As mentioned, the gaps are 0.060" and consist of phenolic spacers with excellent dielectric properties. The primary bobbin has individual slots for the primary winding L5, feedback winding L1, and auxillary winding L6; all wound with litz wire which reduces heat loss. The secondary bobbin is divided into 6 slots with 4 termination pins for the high voltage windings L2 and L3. Winding L2 is wound in 3 slots on one end of the bobbin and winding L3 is similarly wound on the other end. Windings L2 and L3 are wound from the center of the bobbin to either end to insure equal inductance and distributed capacitance to earth ground of both windings. The centertap traces 130 and 62 terminate on the printed circuit board providing for a series connection of rectifier bridge D8. GTO-10, 10 kilovolt cable terminate the ends of windings L2 and L3 at traces 150 and 154.

Secondary windings L2 and L3 are preferably epoxy encapsulated. In the experimental embodiment of the invention, the wound secondary bobbin inserts into a potting cup which provides a hole on either side of the cup to receive extensions of the secondary bobbin which protrude through the cup holes. An inner hole through the tube of the bobbin allows installation of the ferrite cores after the encapsulation process. A suitable epoxy material, which has been desired, is metered into the cup and bobbin while mounted to a fixture in a vacuum chamber where all air is removed from the windings and epoxy. A heat cure is completed after removing the bobbin and cup combination from the vacuum chamber. During encapsulation, all 4 leads are encapsulated by the epoxy to complete the seal of the high voltage windings.

Active, electronic regulation of the load current is desirable to achieve reliable, predictable operation of power supply 30. The circuit 34 is inherently a passive, constant current source which is necessary in driving gas discharge loads where the tube loads are resistive, vary over a wide range, and have a negative resistance coefficient in relationship to their current and power.

In the experimental embodiment of the invention FIGS. 10 through 13 illustrate the dynamic curves of four different sign systems where the current is varied and the current and wattage are metered. The resistance of the load and the voltage across the load are calculated by:

$$E = W/I \text{ and } R = E/I$$

Using 25 ma as the reference current, sign A parameters are: E=3.75 kilovolts, R=150K ohms, & W=94. It is observed that the load resistance decreases as the current through the load increases. Expressed as E=IR, the high voltage curve should vary only slightly as the current varies from 20 ma to 30 ma and the wattage from 70 to 115. The high voltage varies from 3.4 kilovolts to 3.8 kilovolts which is a change of only 400 volts over a 45 watt range. Signs B, C and D demonstrate similar results.

The inductance sum of L2+L3 =1 Henry. The inductance may be calculated as:

$$X_L = 2 \times PI \times FL = 120 \text{ K ohms at 20 KHz.}$$

Figure 14:
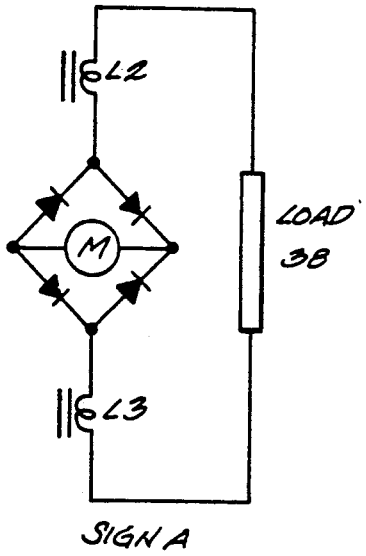
FIG. 14 illustrates the secondary circuit plotted in FIG. 10, sign A.
Figure 15:
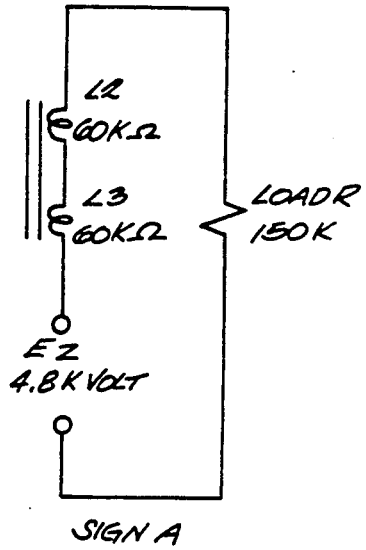
FIG. 15 illustrates the electrical equivalent of the FIG. 14 secondary circuit.
Figure 16:
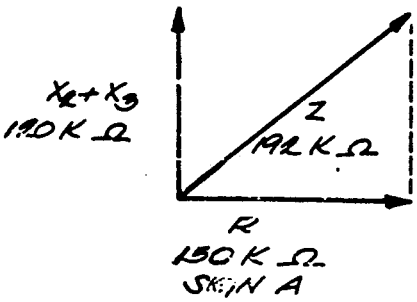
FIG. 16 illustrates the vector relationships of the inductive reactance $X_L$ in kohms vs the dynamic tube load resistance of sign A.
Figure 17:
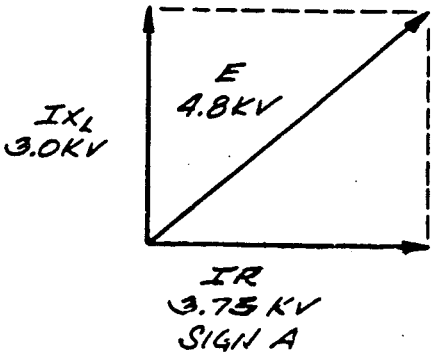
FIG. 17 illustrates the voltage relationships IX , IR, and the induced voltage $E_L$ of sign load A.

FIG. 14 illustrates the circuit of sign A and the equivalent circuit in FIG. 15. FIG. 16 illustrates the X R, & Z vector relationships. FIG. 17 plots the voltage drop across the tube load as IR=3.75 kilovolts; the voltage drop across the secondary inductance $X_L$ as $IX_L$=3.0 kilovolts; and the induced voltage $E_z$=4.8 kilovolts.

The equivalent circuit FIG. 15 illustrates that an inductive reactance of 120 K ohm appears in series with any load 38 connected across the secondary windings L2 and L3 which clearly demonstrates that circuit FIG. 15 is a constant current source in a passive sense. The circuit can tolerate wide variations of loads in terms of wattage without large changes in current A shorted load 38 between terminals 150 and 154 results in all of the induced voltage $E_z$ being dropped across $X_L$ of L2 and L3.

Observing a wattmeter connected to the input of D.C. power supply 70 reveals that very little energy is dissipated with a shorted load circuit and no damage results. All of the induced voltage in L2 and L3 is dropped across the sum of their respective inductive reactances with a zero power factor: Watts=EI×P.F.=O. The limitation on the current is 120K ohms of X and only 300 ohms of resistance, which is the resistance of inductors L2 & L3. Even if the secondary current increased to 50 ma when shorted, practically zero power results because P=I R=0.75 watts. Current regulator 42 prevents the short circuit current from increasing above the set point which limits the short circuit load power to about 0.4 watt.

Load currents of ten gas discharge type signs were compared with and without the active, electronic regulator 42. To disable the regulator, MOSFET Q8 was replaced with an appropriate resistor. Without the regulator, the current varied from 23.6 ma to 37 ma over a wattage range of 15–115 watts. With electronic regulator 42, the current range was 24.0 to 26.0 ma.

| Sign | Without Regulator | With Regulator |
|---|---|---|
| 1 | 29.1 ma | 25.0 ma |
| 2 | 26.4 ma | 25.5 ma |
| 3 | 33.1 ma | 25.2 ma |
| 4 | 28.0 ma | 25.1 ma |
| 5 | 31.7 ma | 25.4 ma |
| 6 | 31.0 ma | 26.0 ma |
| 7 | 31.4 ma | 24.6 ma |
| 8 | 23.6 ma | 25.3 ma |
| 9 | 34.9 ma | 24.0 ma |
| 10 | 37.0 ma | 24.8 ma |

In the experimental embodiment of the invention, the upper limit of the wattage and current control range is 115 watts. At 115 watts of output power, MOSFET Q8' has less than 1 ohm of source to drain resistance representing a full "on" condition and the limit of its control. Under this condition, R16 represents the only resistance in series with feedback winding L1 and the transistor Q1 base and therefore determines the upper load range of the power supply 30. At loads less than 115 watts, the current regulator 42 assumes control and regulates at the set current (25 ma in this example).

If ten tube sections equal to 11.5 watts each at 25 ma are arranged in series and connected to high voltage traces 150 and 154, each 11.5 watt section represents a voltage =11.5/25 ma =460 volts drop and a resistance =460 volts/25 ma =18.4 K ohms. The total wattage, volts, and resistance of the ten sections are: 115 watts, 4.6 kilovolts, and 184 K ohms of resistance.

Adding one additional section of 11.5 watts to the load results in a drop in current to the load because the high voltage limit is 4.6 kilovolts and the load resistance has increased by 18.4 K ohms. Reducing the load from ten sections to three by successively removing one section results in a constant current of 25 ma and a wattage of 11.5 watts per section with normal brightness. This example best describes the importance of current regulator 42 to power supply 30.

The wattage of oscillator 34 and power supply 30 is limited to 115 watts by the amount of current flow through the power transistor Q1. Changing circuit parameters can increase the maximum wattage of the power supply.

FIGS. 2-9 represent actual waveforms at key circuit points of the oscillator 34 and transformer 98, synchronously arranged. As discussed earlier, the oscillator is started by a single pulse from the on-off switch or from a timer whose output is delayed 5 seconds. Transistor Q1 conducts resulting in 160 volts D.C. being applied across the primary winding L5 paralleled by resonant capacitor C6 resulting in a damped wave oscillation of L5 and C6.

Figure 2:
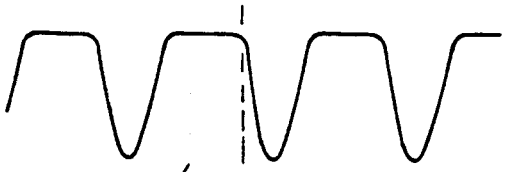
FIG. 2 illustrates the feedback voltage from the high voltage transformer applied between gate and circuit common of the power transistor.
Figure 6:
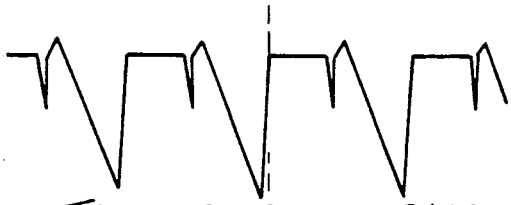
FIG. 6 illustrates the emitter current of the power transistor.
Figure 3:
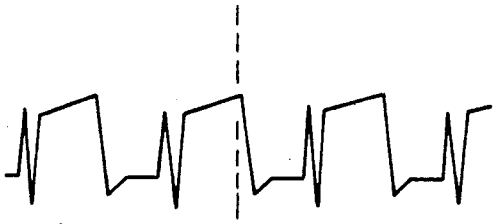
FIG. 3 illustrates the power transistor gate voltage, referenced to common.
Figure 7:
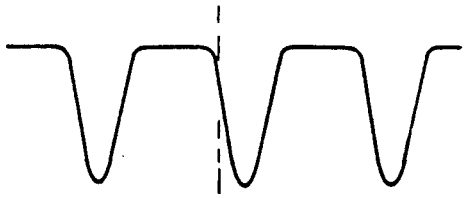
FIG. 7 illustrates the emitter voltage of the power transistor referenced to +160 volts D.C.
Figure 4:
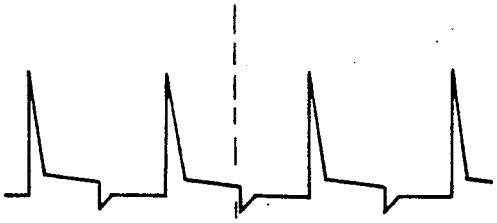
FIG. 4 illustrates the gate current of the power transistor.
Figure 8:
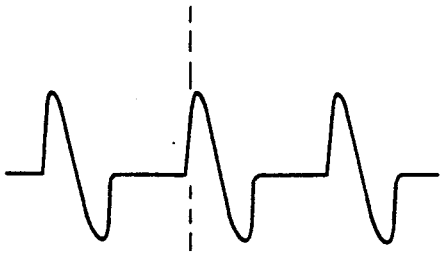
FIG. 8 illustrates the resonant current in the resonanting capacitor.
Figure 5:
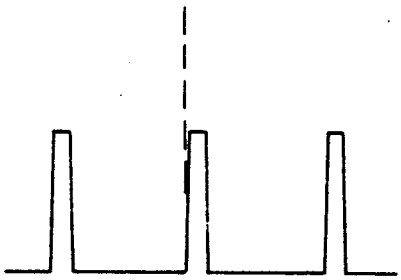
FIG. 5 illustrates the current sense pulse applied to the switching MOSFET which terminates the conduction period of the power transistor.

The waveform illustrated in FIG. 2 is applied regeneratively to the base of power transistor Q1 resulting in sustained oscillation. The amplitude is 30 volts peak. The resultant transistor Q1 base voltage and current are represented by FIGS. 3 and 4 and the emitter current and voltage by FIGS. 6 and 7. After turn on, the current through transistor Q1 and inductor L5 conduct linearly as shown in FIG. 6 until winding L5 begins to saturate causing the I/E relationship to change slightly. Pulse transformer 106 detects the change instantly with a one turn primary winding L4 which is mutually coupled to L7 resulting in the voltage pulse shown in FIG. 5. In FIG. 3 the amplitude 15 volts peak; in FIG. 4, the average drive current is 250 ma peak; in FIG. 5 the peak voltage is +6.8 volts; and in FIG. 6 peak current is 3 amperes when the tube load is 90 watts. The +6.8 volt pulse turns on MOSFET Q5 whose source-drain junction shorts the transistor Q1 gate to circuit common and reverse biases transistor Q1 opening the emitter-collector junction. The effect of the sense pulse illustrated in FIG. 5 is shown in FIG. 4 where the base current is turned off removing the base voltage illustrated in FIG. 3, and resulting in cutting off the emitter current shown in FIG. 6 and beginning the flyback voltage shown in FIG. 7. FIG. 8 illustrates the resonant current in capacitor C6 which conducts during the flyback period and initiates positive feedback from winding L1 to start conduction in Q1 for the succeeding cycle. In FIG. 7 the peak voltage is 600 volts with a 90 watt load and in FIG. 8 the peak-peak current is 4 amperes.

Figure 9:
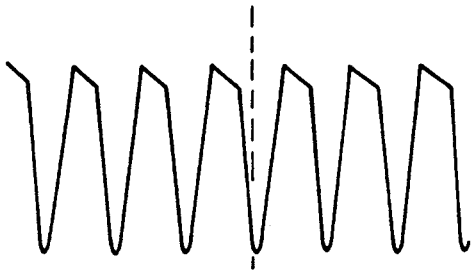
FIG. 9 illustrates the current in the tube load, measured at the centertap of the two secondary windings.
Figure 10:
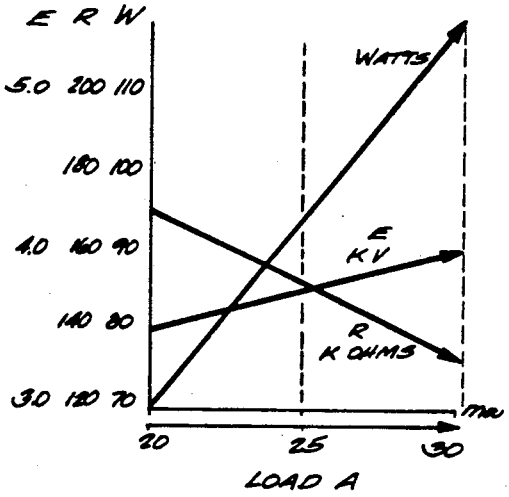
FIG. 10 illustrates a graph of a beverage sign A where load resistance in kohms, load current in ma, load voltage in kilovolts, and load watts are plotted.
Figure 11:
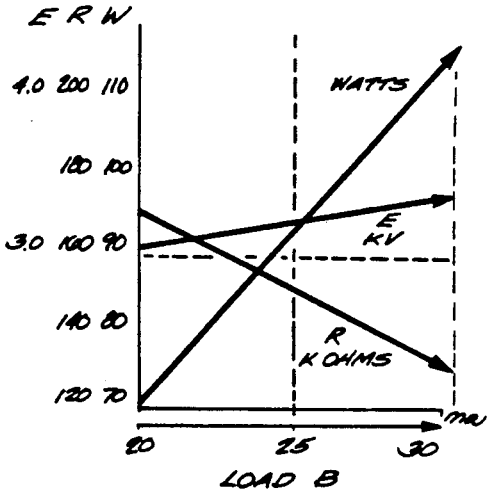
FIGS. 11, 12, and 13 illustrate similar graphs of three other signs B, C, & D.
Figure 12:
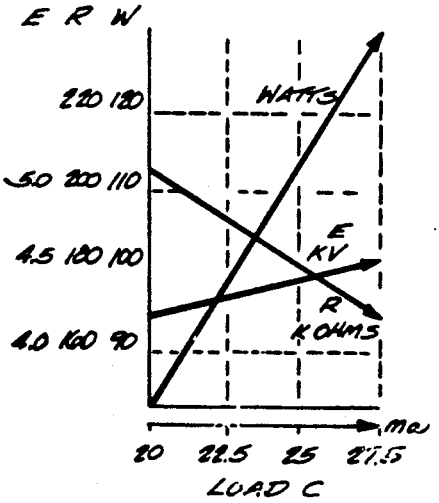
Figure 13:
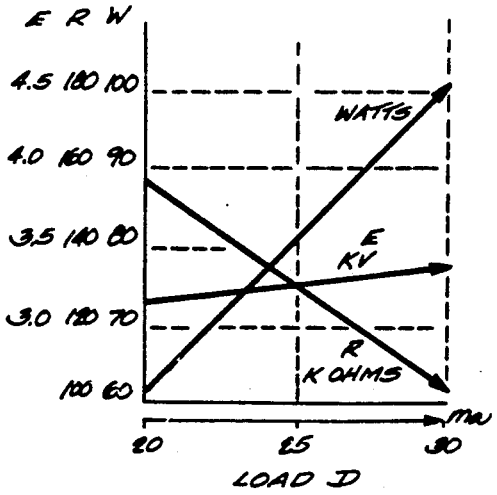

An oscilloscope was arranged in shunt with a 100 ohm resistor in series with the centertap trace 62 to display the load current. FIG. 9 illustrates the waveform of the load current of 26 ma with a 90 watt load.

The secondary current waveform in FIG. 9 also represents the voltage waveform across the tube load. Generally, it is one alternation of a sine wave which is automatically averaged by the high voltage windings L2 and L3 and the load such that equal and opposite average currents flow in the load. No D.C. component is present. Any D.C. component causes electroplating and eventual failure of the tube or electrode.

The energy supplied by the power transistor Q1 to the primary resonant circuit comprising winding L5 and capacitor C6 equals the energy dissipated in the load 38, allowing for small losses resulting from the remaining circuit. When load resistance is decreased, the reflected impedance from windings L2 and L3 reduce the primary $X_L$ increasing the primary current. If the increase does not satisfy the set current of the load, such as 25 ma, the current regulator 42 increases the flyback drive to power transistor Q1 until the load current condition is satisfied.

Typical values of components of the power supply are listed in the following table to enable those of ordinary skill in the art to practice the invention without undue experimentation. Modifications will be obvious to those of ordinary skill in the art.

TABLE OF COMPONENT VALUES

| Comp. | Value |
|---|---|
| R16 | 6.8 meg |
| C13 | 2.2 MF |

-continued

TABLE OF COMPONENT VALUES

| Comp. | Value |
|---|---|
| Q11 | 2N3904 |
| R17 | 12 K |
| R18 | 47 K |
| Q12 | Opto transistor |
| R30 | 4.7 K |
| C14 | .022 MF |
| Q12 | Opto L.E.D. |
| D12 | Diac |
| R2 | 6.8 meg |
| D3 | 12 volt zener |
| C1 | .01 MF . |
| SW | 2P2P |
| Q2 | Opto L.E.D. |
| D4 | Schottky diode |
| R3 | 10 ohms |
| Q5 | P MOSFET |
| D2 | 6.8 volt zener |
| R31 | 10 ohms |
| R1 | 1 ohm |
| C7 | 330 MF |
| Q1 | Bipolar transistor |
| 98 | Power transformer |
| L5 | Primary winding |
| | 102 turns. Litz wire |
| L1/L3 | Secondary Windings |
| | 5 turns ea, Litz wire |
| L2/L3 | Secondary 3 K turns |
| 102 | Ferrite cores "U" type |
| 106 | Pulse transformer |
| L4 | 1 turn primary |
| L7 | 100 turn secondary |
| 110 | Ferrite core. "E" type |
| D8 | 4 1N4148 diodes |
| R11 | 200 ohms |
| 146 | 100 D.C. ma V.O.M. |
| Q6 | Opto L.E.D. |
| R12 | 100 ohm potentiometer |
| C6 | .039 MF |
| R4 | 22 ohms |
| C8 | 330 MF |
| R5 | 1.2 K ohm |
| R6 | 12 K ohms |
| Q8 | N type MOSFET |
| Q7 | 2N3906 |
| R9 | 1.8 K ohms |
| D7 | 6.2 volt zener |
| R10 | 4.7 K ohm |
| Q9 | Triac |
| C10 | .01 MF |
| R8 | 470 ohms |
| Q6 | Opto L.E.D.' |
| R19 | 10 K thermistor |
| C9 | 47 MF |
| D6 | 8.2 volts zener |
| D5 | 1N4148 |
| R7 | 100 ohms |
| Q4 | Triac |
| R15 | 4.7 K |
| Q10 | 2N4990 |
| C12 | 1 MF |
| R14 | 3.9 K |
| Q3' | Opto transistor |
| C11 | 22 MF |
| D11 | 12 volt zener |
| D10 | 1N4148 |
| R13 | 200 ohms |
| Q3 | Opto L.E.D. |
| D9 | 1N4148 |
| 170 | 3 amp |
| C2,C3 | .022 |
| C4 | .022 |
| 82 | 130 V varistor |
| 94 | R.F.I. XFormer |
| D20 | 4 1N5404 bridge |
| C5 | 200 MF |

I claim:

1. A power supply circuit for energizing a gas-filled tube, said circuit including oscillating means, said oscillating means including a transformer having primary winding means and secondary winding means connected to said gas-filled tube, said secondary winding means having first and second winding portions and a tap therebetween, first switching circuit means coupled to said primary winding means and having an on condition for providing current to said primary winding means, and an off condition wherein current does not flow to said primary winding means, feedback means coupled to said primary winding means and to said first switching circuit means, said feedback means being operative to provide a first control signal to the first switching circuit means when a predetermined voltage is induced in said secondary winding means, said first switching circuit means including first control means and being operative to its on condition upon the receipt of the first control signal, first circuit means connected to said first control means for periodically generating said first control signals, and safety circuit means including current responsive means coupled to said tap for measuring the magnitude of an unbalanced current in said secondary winding means, said safety means also including first and second gate means, said first gate means being coupled to said current responsive means, said current responsive means being operative to provide a first gate signal to the first gate means having a magnitude functionally related to the magnitude of the unbalanced current, said first gate means being photoresponsive to a signal from the current responsive means having at least a predetermined minimum level for providing a second gate signal, said second gate means being coupled to said first gate means for receiving said second gate signal and to said feedback means and being operative upon receiving said second gate signal to bypass said first control signal from said first circuit means.

2. The power supply circuit set forth in claim 1 wherein said current responsive means includes light emitting diode means connected between said tap and a fixed reference.

3. The power supply circuit set forth in claim 1 wherein said current responsive means comprises light emitting diode means connected between said tap and a reference having a fixed potential, said photoresponsive first gate means being operative in response to light having a predetermined minimum intensity to provide a gate signal to said second gate means.

* * * * *